US005429030A

United States Patent [19]

Tidman

[11] Patent Number: 5,429,030

[45] Date of Patent: Jul. 4, 1995

[54] HYBRID ELECTROTHERMAL LIGHT GAS GUN AND METHOD

[75] Inventor: Derek A. Tidman, McLean, Va.

[73] Assignee: GT-Devices, Alexandria, Va.

[21] Appl. No.: 149,354

[22] Filed: Nov. 9, 1993

[51] Int. Cl.[6] ..... F41B 6/00

[52] U.S. Cl. ..... 89/7; 89/8; 102/202.7; 102/440; 102/443

[58] Field of Search ..... 89/7, 8; 102/202.7, 102/440, 443, 702

[56] References Cited

U.S. PATENT DOCUMENTS

| | | | |
|---|---|---|---|
| 1,920,075 | 7/1933 | Haenichen | 102/443 |
| 3,143,069 | 8/1964 | Ostrow | 102/531 |
| 3,618,380 | 11/1971 | Marston et al. | 73/147 |
| 4,715,261 | 12/1987 | Goldstein et al. | 89/8 |
| 4,907,487 | 3/1990 | Tidman et al. | 89/8 |
| 4,913,029 | 4/1990 | Tidman et al. | 89/8 |
| 5,012,719 | 5/1991 | Goldstein et al. | 89/8 |
| 5,233,903 | 8/1993 | Saphier et al. | 89/7 |

OTHER PUBLICATIONS

Henderson, World's Largest Light Gas Gun Nears Completion at Livermore, *Aviation Week and Space Technology*, Aug. 10, 1992, pp. 57 and 59.

Tidman et al., Electrothermal Light Gas Gun, *IEEE Transactions on Magnetics*, vol. 29, Jan. 1993, pp. 621-624.

*Primary Examiner*—Stephen C. Bentley

*Attorney, Agent, or Firm*—Lowe, Price, LeBlance & Becker

[57] ABSTRACT

A pressurized light gas in a first chamber segment of a light gas gun is heated and highly pressurized by an electric discharge. Solid chemical propellant in a second chamber segment behind and separated from the first chamber segment by a perforated wall is ignited by the heated and highly pressurized light gas to form a gaseous piston to assist in accelerating the light gas against a projectile.

20 Claims, 2 Drawing Sheets

HYBRID ELECTROTHERMAL LIGHT GAS GUN AND METHOD

This invention was made with Government support under Contract No. DASG6089C0117 awarded by the United States Army. The Government has certain rights in the invention.

FIELD OF THE INVENTION

The present invention relates generally to light gas guns and methods and more particularly to a light gas gun and method wherein a pressurized light gas in a first chamber segment is heated and highly pressurized by an electric discharge and wherein solid chemical propellant in a second chamber segment behind and separated from the first chamber segment by a perforated wall is ignited by the heated and highly pressurized light gas to form a gaseous piston to assist in accelerating the light gas against a projectile.

BACKGROUND ART

A light gas gun is a projectile launcher employing a gas having a low atomic number, specifically hydrogen or helium. The light gas is heated and pressurized in a chamber having a diaphragm behind a projectile. In response to the heating and pressurizing, the light gas ruptures the diaphragm and then is accelerated at very high velocity against the rear of the projectile to accelerate the projectile from a breech of a barrel to the barrel muzzle. Light gases are particularly advantageous for this purpose because they have very high sound speed. As the molecular weight of a gas increases, the sound speed of the gas decreases as an inverse square root function of molecular weight.

In the prior art, to enable the light gas to achieve the necessary pressure and temperature to accelerate a projectile to very high velocity, the gas is compressed by a mechanical piston driven along a "pump tube" by an electrically activated powder charge. The mechanical pistons are removed only with great difficulty from the gun barrel after a projectile is launched and the pump tube is heavy. Hence, prior art light gas guns have not been practical for field use.

It has also been suggested to provide light gas guns wherein a highly energetic electric arc is supplied to the light gas by a high voltage pulsed power supply that is connected across a metal fuse. The high voltage power supply typically has many kilojoules of energy, causing the light gas to become a strong plasma having very high temperatures that can damage a barrel wall. In addition, high energy electric power supplies have known disadvantages, curtailing the portability of light gas guns using such supplies.

It is, accordingly, an object of the present invention to provide a new and improved light gas gun and method having a reduced electric power supply.

Another object of the present invention is to provide a new and improved light gas gun and method, wherein the gun can be transported from place to place and can be used in the field.

A further object of the invention is to provide a new and improved light gas gun and method, wherein the gun is easily reused from shot to shot because it does not employ a mechanical piston and gases traversing the gun barrel are at relatively moderate temperatures that do not cause significant barrel damage.

THE INVENTION

In accordance with one aspect of the invention, a light gas gun for accelerating a projectile in a barrel comprises a chamber located behind the projectile for supplying accelerating gas to a base of the projectile and a wall separating the chamber into first and second segments. A light gas is supplied to the first chamber segment and to a solid chemical propellant in the second chamber segment. In a preferred embodiment the light gas flows through perforations in the relatively thin wall separating the two chamber segments. An electric discharge is established in the light gas in the first chamber segment. The wall, chamber segments and a diaphragm between the first chamber segment and the projectile base are arranged so highly pressurized light gas from the first segment resulting from the electric discharge is heated and further pressurized to burst the diaphragm and accelerate the projectile at approximately the same time as the heated light gas flows through the wall into the second chamber to ignite the solid chemical propellant. The ignited solid chemical propellant detaches the wall from the chamber and causes accelerating pressure to be exerted on the light gas accelerating the projectile.

In accordance with a further aspect of the invention a projectile in a barrel of a light gas gun is accelerated by loading a relatively cool light gas into a first chamber segment separated by a wall from a second chamber segment including a solid chemical propellant, that is immersed in the cool light gas at about the same time as the cool light gas is loaded into the first chamber segment. An electric discharge is established in the light gas in the first chamber segment to highly pressurize the light gas in the first chamber segment. The highly pressurized light gas flows into (a) the barrel against the projectile to accelerate the projectile in the barrel and (b) the second chamber segment through the wall to ignite the solid chemical propellant immersed in cool light gas in the second chamber. The ignited solid chemical propellant flows in the second chamber segment (a) against the wall to detach the wall from the chamber and (b) then through the first chamber segment into the barrel to exert an accelerating force on the pressurized light gas accelerating the projectile.

In the preferred embodiment wherein the wall includes perforations for supplying pressurized light gas initially supplied to the first chamber segment to the second chamber segment, highly pressurized light gas is also supplied through the perforations from the first chamber segment to the second chamber segment as jets heated by the discharge.

In a preferred embodiment the discharge is established by a metal fuse extending through the light gas in the first chamber segment. A power supply supplies to the fuse a pulse having sufficient duration and power to rupture the fuse and establish the discharge in the light gas. The power supply can have a relatively low energy level, causing gases flowing from the chamber to the barrel to have relatively low temperatures in the range of 1,000° K.–2,500°K.

Preferably the fuse includes a source of electrons for seeding the discharge, particularly from Al or Li atoms. The seeding electrons and placement of the fuse enable a long arc to be established in the light gas, permitting the power supply voltage to be limited to the 10,000–20,000 volt range.

In a preferred embodiment, the length of the barrel and the arrangements of the (a) wall, (b) the first and second chamber segments, (c) solid chemical propellant, (d) light gas, and (e) electric discharge are such that the ignited solid chemical propellant and the highly pressurized light gas do not significantly mix while the projectile is traversing the barrel. The insignificant amount of mixing is such that the sound speed of the light gas acting on the projectile base is maintained at a high enough velocity to have no appreciable effect on the gun performance. Significant mixing of the ignited propellant and light gas would materially reduce the light gas speed and appreciably reduce the projectile speed.

In addition, these parameters are such that the detached wall flows with the ignited solid propellant through the barrel and out of the barrel muzzle. Such a feature is highly advantageous because virtually all solid material in the barrel before a "shot" occurs is removed from the barrel during the shot. Thereby, the gun can easily and quickly be re-used for a subsequent shot.

The above and still further objects, features and advantages of the present invention will become apparent upon consideration of the following detailed description of a specific embodiment thereof, especially when taken in conjunction with the accompanying drawings.

DESCRIPTION OF THE PREFERRED EMBODIMENT

Figure 1:
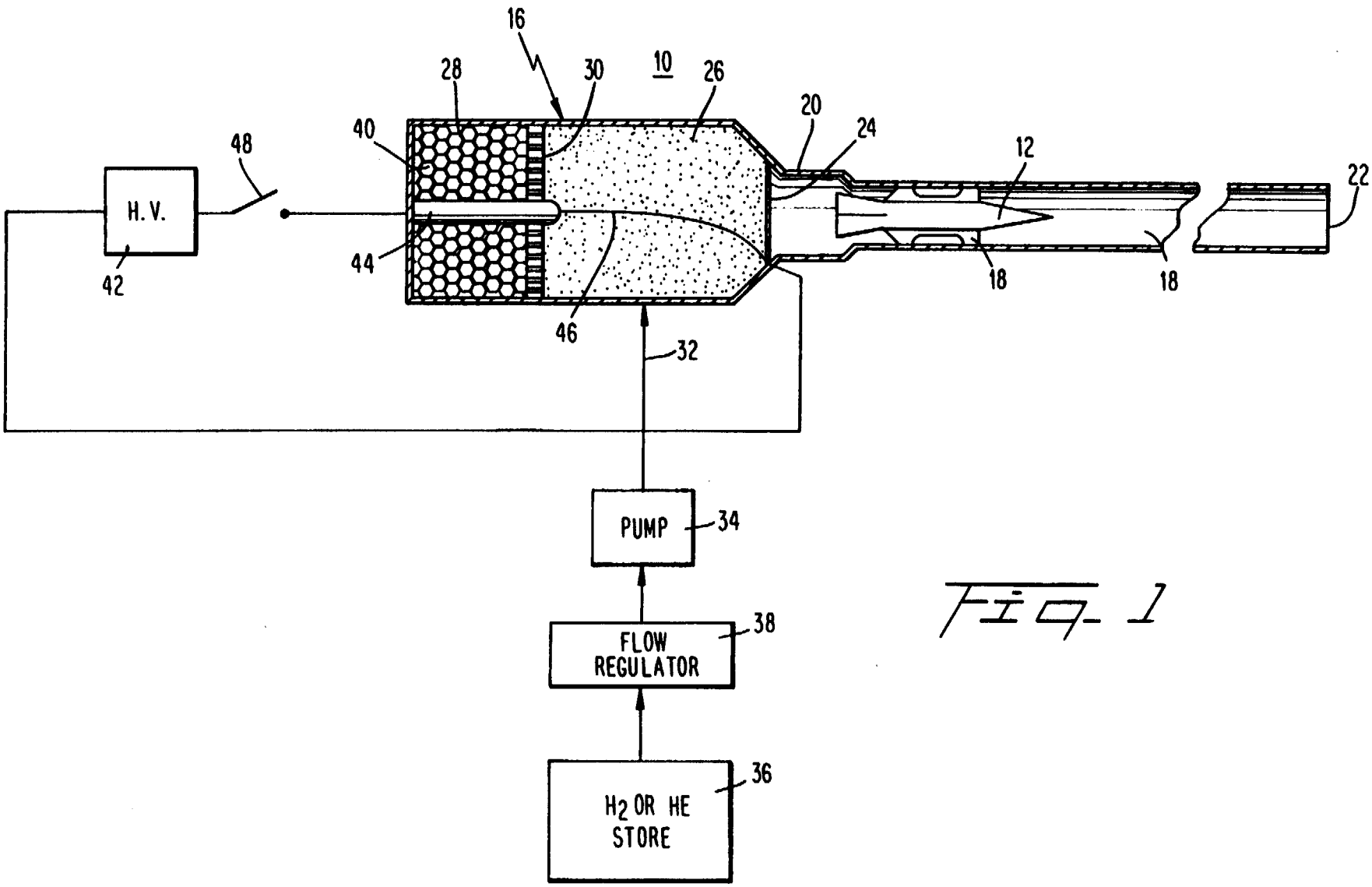
FIG. 1 is a schematic diagram of a preferred embodiment of a light gas gun in accordance with the present invention.

Reference is now made to FIG. 1 of the drawing wherein light gas gun 10 for accelerating projectile 12 is illustrated as including barrel 14 and propellant chamber 16. Projectile 12 is initially loaded on sabot 18, adjacent breech 20 of barrel 14 and is accelerated in response to high pressure gas applied to the projectile from chamber 16, to be accelerated down barrel 14 and through muzzle 22. Breech 20 is immediately downstream of solid diaphragm 24, at the forward end of propellant chamber 16.

Propellant chamber 16 includes first, forward segment 26 and second, rear segment 28, separated from each other by perforated wall 30, preferably fabricated of a plastic, lightweight material having small holes extending through it in the axial direction of barrel 14. Typically, forward chamber segment 26 has a volume approximately twice that of rear chamber segment 28. Chamber 16 is sealed but includes, in forward segment 26 thereof, an opening leading to pipe 32, connected to an outlet of pump 34, in turn connected to gas source 36 by flow regulator 38.

Light gas, specifically hydrogen ($H_2$) or helium (He), at room temperature (about 300° K.), flows from gas source 36 under the control of flow regulator 38. The volume of helium or hydrogen in chamber segment 26 is typically about one half of the volume of barrel 14 between breech 20 and muzzle 22. The gas from source 36 is pressurized by pump 34 to a pressure of 10,000–20,000 psi and flows via conduit 32 into chamber 16. The high pressure gas flows into chamber segment 26, thence into chamber segment 28 through the small holes in wall 30. While both hydrogen and helium can be used, helium is preferred because of its inert properties and reduced muzzle blast.

Chamber 28 is initially filled with a typical solid chemical propellant 40, such as granular propellant, e.g., gunpowder; alternatively, solid chemical propellant 40 in chamber segment 28 is formed as rods extending in the same direction as the axis of barrel 14 or it may have any other suitable configuration having a relatively large surface area so the propellant is quickly and completely ignited by a light gas having sufficiently high temperature. The pressurized light gas flowing through the perforations in wall 30 fills the interstices between the surfaces of solid propellant 40.

Electric heating of the light gas in chamber segment 26 is provided by a pulse from high voltage source 42, having a terminal connected to a corner of metal diaphragm 24 that remains intact and in place when the diaphragm bursts. Source 42 has a second terminal that is connected to electrode 44 when the contacts of switch 48 are closed. Electrode 44 extends in the direction of the axis of barrel 14 from the rear of chamber segment 28, through wall 30 into chamber segment 26. The end of electrode 44 extending into chamber segment 26 is connected by electrothermal fuse 46 to the corner of diaphragm wall 24 that remains intact and in place when the diaphragm bursts. Voltage source 42 typically has a moderately high voltage in the 10–20,000 volt range.

Figure 2:
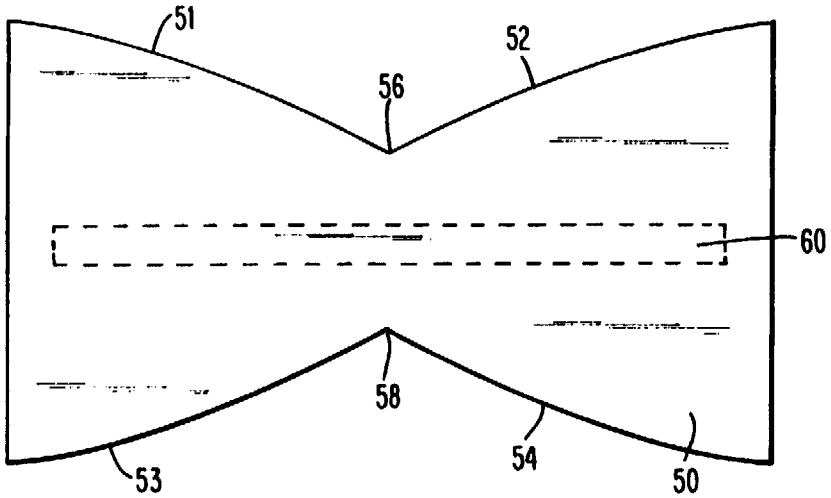
FIG. 2 is a schematic diagram of a fuse of the type preferably employed in the light gas gun of FIG. 1.

A preferred configuration of metal fuse 46 is illustrated in FIG. 2 as foil 50 having a "bow tie" shape that is folded and connected between the end of electrode 44 and the corner of diaphragm 24. Foil 50 thus includes four tapered longitudinally extending walls 51–54 such that walls 51 and 52 intersect at point 56, while walls 53 and 54 intersect at point 58. Points 56 and 58 thus define a neck of foil 50, approximately one-half way between opposite ends of the foil, connected respectively to diaphragm 24 and electrode 44. In one preferred embodiment, foil 50 is formed of aluminum and a lithium hydride powder strip 60 extends longitudinally of walls 51–54 from close to one end of the foil to close to the other end of the foil. Alternatively, the lithium hydride powder strip 60 is eliminated and the entire foil is made of an appropriate aluminum-lithium alloy. Foil 50 is rolled and connected in first chamber segment 26 so that the neck between points 56 and 58 is close to the center of the first chamber segment.

In response to closure of switch 48, current is applied to foil 50. The center of the foil, in the neck between points 56 and 58, initially explodes to form a gap and discharge arc across the neck. The discharge arc gradually lengthens, typically in several tens of microseconds, to fill the electrode gap with the discharge. During this process, the electric discharge arc and light gas are seeded with electrons from the lithium and aluminum to enhance electrical conductivity of the arc, to obviate the need for a voltage of source 40 in excess of 10–20 kV. The relatively high conductivity of the seeded helium or hydrogen allows long arcs for large guns and relatively low voltages. Typically, the seeded hydrogen or helium in chamber 26 has a sound speed that is approximately 95 percent or 94 percent that of pure helium or pure hydrogen, respectively. The arc is initially established early in the pulse supplied by high voltage supply 42 through switch 48 to fuse 46.

The electric energy in the arc formed as a result of the discharge in fuse 46 heats and pressurizes the gas in chamber segment 26, without forming a hydrogen or helium plasma or by forming a very weak plasma having a relatively small number of free charge carriers. The gas is typically heated to the relatively low temperature of between 1,000°-3,000° Kelvin. The pressure of the light gas in chamber 26 increases from its initial 10,000-20,000 psi pressurized level to become highly pressurized to about 4,000 atmospheres. Diaphragm 24 is able to withstand the initial 10,000-20,000 psi pressure of the light gas in chamber 24, but bursts in response to the application of the highly pressurized gas resulting from ignition of the light gas by rupture of fuse 46. The highly pressurized light gas flows from chamber segment 26 through burst diaphragm 24 against the rear of projectile 12 and starts to accelerate the projectile through barrel 14 toward the barrel muzzle 22.

Figure 3:
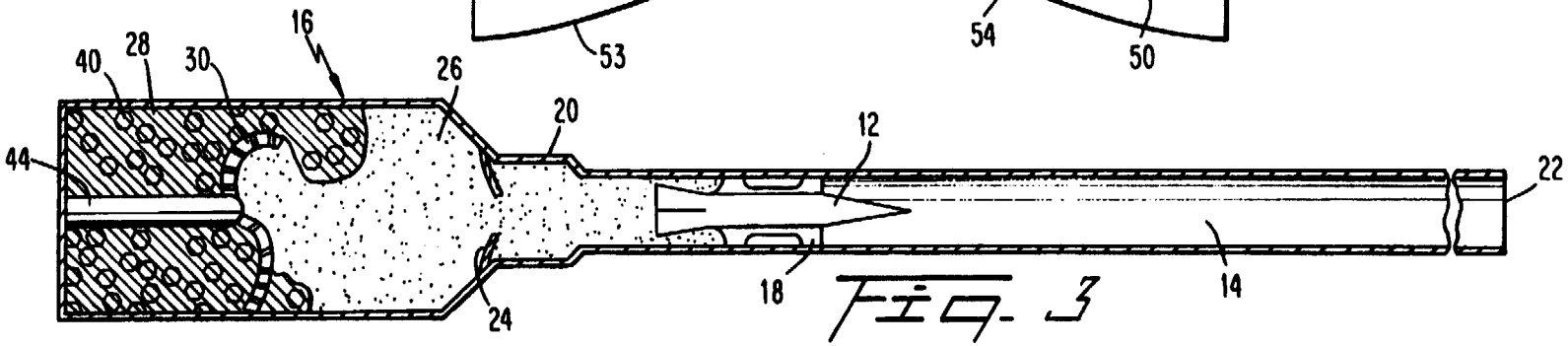
FIG. 3 is a diagram indicating the state of the apparatus illustrated in FIG. 1 shortly after an electric discharge has been applied to the light gas.

At about the same time diaphragm 24 bursts, jets of hot high pressure hydrogen or helium from chamber segment 26 penetrate the holes in wall 30 and flow into chamber segment 28 around solid, chemical propellant 40. The hot light gas flowing around solid, chemical propellant 40 ignites the propellant into a burning state. The burning solid propellant 40 then expands forward, breaks wall 30 from the interior surfaces of chamber 16 and begins to push the wall, as illustrated in FIG. 3. The pressure of the light gas flowing from chamber 26 into breech 20 of barrel 14 and bearing against the back end of projectile 12 is initially maintained at the high 4 kilobar range as a result of expansion of the solid propellant in chamber segment 28. When the burning solid propellant 40 has expanded into the entrance of barrel 16, at breech end 20, the high pressure, light gas originally in chamber segment 26 is decoupled from the slower gases resulting from ignition of the solid chemical propellant in chamber segment 28. All of the grains of solid propellant 40 are burnt up by the time projectile 12 has advanced about one-third down the length of barrel 14 from its initial position to muzzle 22.

Figure 4:
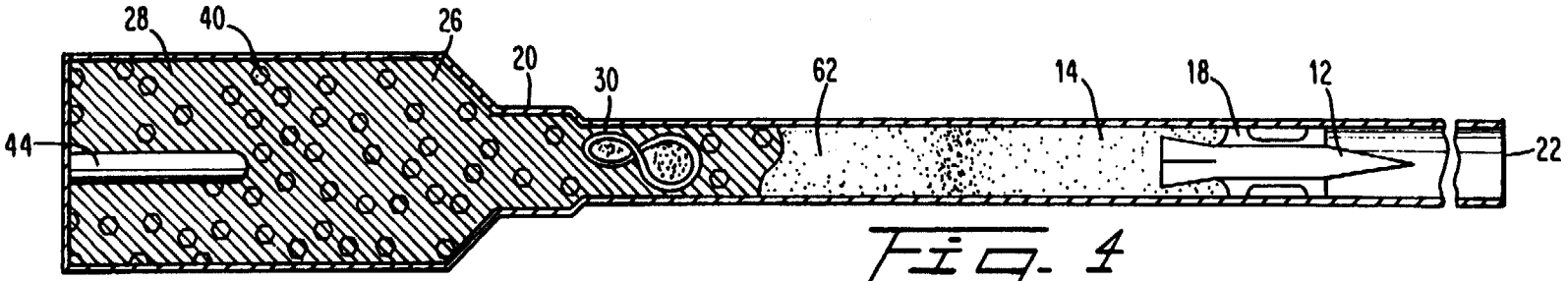
FIG. 4 is a diagram of the condition of the structure illustrated in FIG. 1 at a time somewhat subsequent to the time illustrated in FIG. 3.

As time progresses, as illustrated in FIG. 4, wall 30 enters barrel 16 through breech 20 and is ultimately ejected from muzzle 22 with the gas resulting from ignition of solid propellant 40. Rarefacation, low pressure zone 62 is formed between the back end of the high sound speed high velocity mass of light gas traversing barrel 14 and the lower speed gases resulting from ignition of the solid chemical propellant initially in chamber segment 28. The burn time of the solid propellant 40 is matched to the movement of projectile 12 through barrel 14. The geometries of barrel 14 and chamber 16, the masses of the light gas in chamber segment 26 and the mass of the solid chemical propellant in chamber segment 28 and the electrical activation parameters associated with the discharge are such that rarefacation zone 62 does not catch projectile 12 before the projectile exits muzzle 22 of barrel 14. The high sound speed of the hot helium or hydrogen maintains a high pressure accelerating force on the base of projectile 12 for velocities in excess of 3 kms/second.

In the schematic drawings of FIGS. 3 and 4 the solid propellant particles 40 are represented by hexagons while the gas resulting from ignition of the particles is represented by solid diagonal lines in chamber segments 26 and 28 and barrel 14.

In one device that was actually built and tested, a 17.6 gram projectile was accelerated through a 16 mm barrel to a velocity of about 3.4 kms/second. This structure scales to a similar velocity for a 5 kilogram projectile in a 105 mm barrel. Typically, the ratio of the mass of the projectile to the mass of the helium is approximately 1, and the ratio of the mass of the solid propellant to the mass of the projectile is in the 2-6 range. The kinetic energy of the projectile, at the time the projectile traverses muzzle 22, is typically between one and two times the electrical energy imparted to fuse 46 by source 42.

While there has been described and illustrated one specific embodiment of the invention, it will be clear that variations in the details of the embodiment specifically illustrated and described may be made without departing from the true spirit and scope of the invention as defined in the appended claims. While the preferred embodiment includes thin perforated wall 30 through which high velocity gas jets blow from first chamber segment 26 to second chamber segment 28, it is to be realized that similar results can be attained by using a thin solid wall having leakage around the periphery thereof or by pumping gas from source 36 into both chamber segments 26 and 28 via separate flow paths prior to closure of switch 48.

I claim:

1. A light gas gun for accelerating a projectile in a barrel comprising a chamber located behind the projectile for supplying accelerating gas to a base of the projectile, a wall in the chamber separating the chamber into first and second segments, means for supplying a light gas to the first chamber segment, a solid chemical propellant in the second chamber segment, means for establishing an electric discharge in gas in the first chamber segment, and a diaphragm between the first chamber segment and the projectile base; the wall, chamber segments and diaphragm being arranged so highly pressurized light gas from the first chamber segment resulting from the electric discharge bursts the diaphragm and accelerates the projectile at approximately the same time it flows from the first chamber segment to the second chamber segment to ignite the solid chemical propellant, the ignited solid chemical propellant detaching the wall from the chamber and causing accelerating pressure to be exerted on the light gas accelerating the projectile.

2. The light gas gun of claim 1 wherein the light gas supplied to the first chamber segment is pressurized, the wall including perforations for supplying from the first chamber segment to the second chamber segment (a) the light gas as supplied to the first chamber segment and (b) the highly pressurized light gas as jets heated by the discharge.

3. The light gas gun of claim 2 wherein the length of the barrel, the arrangements of the (a) wall, (b) the first and second chamber segments, (c) solid chemical propellant, (d) light gas, and (e) electric discharge are such that the ignited solid chemical propellant and the highly pressurized light gas do not significantly mix while the projectile is traversing the barrel.

4. The light gas gun of claim 3 wherein the arrangements of the (a) wall, (b) the first and second chamber segments, (c) solid chemical propellant, (d) light gas, and (e) electric discharge are such that the detached wall flows with the ignited solid propellant through the barrel.

5. The light gas gun of claim 3 wherein the means for establishing the discharge includes: a metal fuse extending through the light gas in the first chamber segment, a power supply for supplying a pulse to the fuse, the pulse having sufficient duration and power to vaporize the fuse and establish the discharge in the light gas.

6. The light gas gun of claim 1 wherein the means for establishing the discharge includes: a metal fuse extending through the light gas in the first chamber segment, a power supply for supplying a pulse to the fuse, the pulse having sufficient duration and power to vaporize the fuse and establish the discharge in the light gas.

7. The light gas gun of claim 6 wherein the fuse includes metal atoms that provide a source of electrons for seeding the discharge.

8. The light gas gun of claim 7 wherein the fuse includes Al or Li atoms from which the seeding electrons are derived.

9. The light gas gun of claim 1 wherein the means for supplying the light gas comprises a pressurized source of the light gas.

10. The light gas gun of claim 1 wherein the length of the barrel, the arrangements of the (a) wall, (b) the first and second chamber segments, (c) solid chemical propellant, (d) light gas, and (e) electric discharge are such that the ignited solid chemical propellant and the highly pressurized light gas do not mix significantly while the projectile is traversing the barrel.

11. The light gas gun of claim 1 wherein the arrangements of the (a) wall, (b) the first and second chamber segments, (c) solid chemical propellant, (d) light gas, and (e) electric discharge are such that the detached wall flows with the ignited solid propellant through the barrel.

12. A method of accelerating a projectile in a barrel of a light gas gun including a chamber comprising loading a light gas into first and second segments of the chamber separated from each other by a wall in the chamber, the second chamber segment including a solid chemical propellant, establishing an electric discharge in the light gas in the first chamber segment to highly pressurize the light gas in the first chamber segment, flowing the highly pressurized light gas into (a) the barrel against the projectile to accelerate the projectile in the barrel and (b) the second chamber segment to ignite the solid chemical propellant in the second chamber segment, and flowing the ignited solid chemical propellant in the second chamber segment (a) against the wall to detach the wall from the chamber and (b) then through the first chamber segment into the barrel to exert an accelerating force on the pressurized light gas accelerating the projectile.

13. The method of claim 12 wherein the ignited solid chemical propellant and the highly pressurized light gas do not mix significantly while the projectile is traversing the barrel.

14. The method of claim 12 wherein the light gas loaded in the first chamber segment is pressurized and flows through perforations in the wall into the second chamber segment through interstitial spaces in the solid chemical propellant.

15. The method of claim 14 wherein the light gas loaded in the first chamber segment is pressurized to a pressure in the range of about 10,000 to 20,000 psi.

16. The method of claim 15 wherein the light gas is highly pressurized by the discharge to a pressure of about 4 kilobars and heated by the discharge to a temperature in the range of 1000° K.–2500° K.

17. The method of claim 12 wherein the discharge is established by supplying an electric pulse to a metal fuse in the first chamber segment, the pulse having sufficient duration and power to vaporize the fuse, and seeding the discharge with free electrons from metal in the vaporized fuse.

18. The method of claim 12 wherein the highly pressurized light gas flows into the second chamber through the wall.

19. The method of claim 12 wherein the light gas loaded in the first chamber segment is pressurized and flows into the second chamber segment through interstitial spaces in the solid chemical propellant.

20. The method of claim 12 wherein the detached wall flows with the ignited solid propellant through the barrel.

* * * * *